US007621652B2

(12) United States Patent
Zick

(10) Patent No.: US 7,621,652 B2
(45) Date of Patent: Nov. 24, 2009

(54) ELECTRICAL COMPONENT, SUCH AS A LIGHTING UNIT AND BATTERY CHARGER ASSEMBLY

(75) Inventor: Jonathan Zick, Waukesha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 272 days.

(21) Appl. No.: 11/393,258

(22) Filed: Mar. 30, 2006

(65) Prior Publication Data

US 2006/0221602 A1 Oct. 5, 2006

Related U.S. Application Data

(60) Provisional application No. 60/667,147, filed on Mar. 31, 2005.

(51) Int. Cl.
*F21V 19/04* (2006.01)
*F21L 4/00* (2006.01)

(52) U.S. Cl. ..... 362/183; 362/20; 362/197

(58) Field of Classification Search ..... 362/183, 362/20, 85, 154, 157, 184, 190, 191, 194, 362/195, 197, 198, 285, 418
See application file for complete search history.

(56) References Cited

U.S. PATENT DOCUMENTS 1,309,140 A 7/1919 Knoblock
3,787,678 A * 1/1974 Rainer ..... 362/183
3,792,314 A 2/1974 Epstein et al.
3,916,212 A 10/1975 Prochazka et al.
3,963,972 A 6/1976 Todd
4,000,403 A 12/1976 Rice
4,096,553 A 6/1978 Roche
4,156,891 A 5/1979 Roche
4,216,410 A 8/1980 Feldstein (Continued)

FOREIGN PATENT DOCUMENTS

CA 1340662 3/1989

(Continued)

OTHER PUBLICATIONS www.ledtronics.com/DS/GDL002-200/default.asp, Architectural and Landscape LED Floodlight, printed Jul. 22, 2004.

(Continued)

*Primary Examiner*—Bao Q Truong
(74) *Attorney, Agent, or Firm*—Michael Best & Friedrich LLP

(57) ABSTRACT

An electrical component, such as a light, a floodlight, a lighting unit and battery charger assembly. The light may include a light body including an illuminating portion, a housing operable to support the light body, the housing being operable to support a removable power tool battery pack, and an operational circuit supported by the housing, the operational circuit being electrically connectable between the illuminating portion and the battery pack such that power is suppliable to the illuminating portion, the circuit including a battery charging circuit portion electrically connectable between the battery pack and a power source such that power is suppliable from the power source to the battery pack to charge the battery pack. The operational circuit may be electrically connectable between the illuminating portion and the power source such that power is suppliable to the illuminating portion from the power source.

33 Claims, 9 Drawing Sheets

U.S. PATENT DOCUMENTS

| | | | | |
|---|---|---|---|---|
| 4,364,104 | A | 12/1982 | Holahan et al. | |
| 4,382,220 | A | 5/1983 | Marshall et al. | |
| 4,410,835 | A | 10/1983 | Zabroski | |
| 4,544,994 | A | 10/1985 | Steeves, Jr. | |
| 4,575,784 | A | 3/1986 | Diau | |
| 4,626,975 | A | 12/1986 | Miletich | |
| 4,686,424 | A | 8/1987 | Nuckolls et al. | |
| 4,691,157 | A | 9/1987 | McDermott | |
| 5,010,454 | A * | 4/1991 | Hopper | 362/487 |
| 5,012,394 | A | 4/1991 | Woodward | |
| 5,148,158 | A | 9/1992 | Shah | |
| 5,152,601 | A | 10/1992 | Ferng | |
| 5,169,225 | A | 12/1992 | Palm | |
| 5,202,608 | A | 4/1993 | Johnson | |
| 5,203,621 | A | 4/1993 | Weinmeister et al. | |
| 5,465,196 | A | 11/1995 | Hasenberg et al. | |
| 5,471,114 | A | 11/1995 | Edwards et al. | |
| 5,587,645 | A | 12/1996 | Sciammarella et al. | |
| 5,592,066 | A | 1/1997 | Fan | |
| 5,646,486 | A | 7/1997 | Edwards et al. | |
| 5,685,637 | A | 11/1997 | Chapman et al. | |
| 5,746,495 | A | 5/1998 | Klamm | |
| 5,896,024 | A | 4/1999 | Bradus et al. | |
| 5,912,546 | A | 6/1999 | Sakou et al. | |
| 5,986,407 | A | 11/1999 | Chang | |
| 5,988,828 | A | 11/1999 | Prince et al. | |
| 5,988,833 | A | 11/1999 | Giese et al. | |
| 6,019,484 | A | 2/2000 | Seyler | |
| 6,034,505 | A | 3/2000 | Arthur et al. | |
| 6,045,232 | A * | 4/2000 | Buckmaster | 362/20 |
| 6,050,710 | A | 4/2000 | Grossman et al. | |
| 6,053,315 | A | 4/2000 | Yao | |
| 6,128,287 | A | 10/2000 | Freeburg et al. | |
| 6,154,008 | A | 11/2000 | Bradus et al. | |
| 6,176,593 | B1 | 1/2001 | Spitler et al. | |
| 6,215,276 | B1 | 4/2001 | Smith | |
| 6,222,343 | B1 | 4/2001 | Crisp et al. | |
| 6,260,985 | B1 | 7/2001 | Zeller | |
| 6,308,059 | B1 | 10/2001 | Domes | |
| 6,328,460 | B1 | 12/2001 | Grossman et al. | |
| 6,354,720 | B2 | 3/2002 | Grossman et al. | |
| 6,361,184 | B1 | 3/2002 | Hallgrimsson et al. | |
| 6,406,161 | B1 * | 6/2002 | Lin et al. | 362/85 |
| 6,431,726 | B1 | 8/2002 | Barton | |
| 6,456,035 | B1 | 9/2002 | Crisp et al. | |
| 6,502,949 | B1 | 1/2003 | Horiyama et al. | |
| 6,533,434 | B2 | 3/2003 | Yuen | |
| 6,575,590 | B1 | 6/2003 | Wadsworth | |
| 6,585,400 | B2 | 7/2003 | Leen | |
| 6,636,015 | B1 | 10/2003 | Levine et al. | |
| 6,897,785 | B2 | 5/2005 | Corbus | |
| 6,902,293 | B2 | 6/2005 | Tang | |
| 6,977,481 | B2 | 12/2005 | Smith | |
| 7,222,986 | B2 | 5/2007 | Mah | |
| 2001/0009515 | A1 | 7/2001 | Grossman et al. | |
| 2002/0021573 | A1 | 2/2002 | Zhang | |
| 2002/0158605 | A1 * | 10/2002 | Sharrah et al. | 320/115 |
| 2002/0181230 | A1 | 12/2002 | Yuen | |
| 2002/0191396 | A1 | 12/2002 | Reiff et al. | |
| 2003/0007355 | A1 | 1/2003 | Leen | |
| 2003/0081412 | A1 | 5/2003 | Sharrah | |
| 2003/0095403 | A1 | 5/2003 | Tang | |
| 2003/0161146 | A1 | 8/2003 | Sharrah et al. | |
| 2004/0179361 | A1 | 9/2004 | Hussaini et al. | |
| 2005/0156564 | A1 | 7/2005 | Krieger | |
| 2005/0157482 | A1 * | 7/2005 | Hsu | 362/20 |
| 2007/0024237 | A1 | 2/2007 | Cole, Jr. et al. | |

FOREIGN PATENT DOCUMENTS

| | | |
|---|---|---|
| CA | 1340662 | 7/1999 |
| CN | 2303150 Y | 1/1999 |
| DE | 203 15 308 | 3/2005 |
| EP | 1312855 | 5/2003 |
| EP | 1312855 A2 | 5/2003 |
| JP | 09154237 | 6/1997 |
| JP | 9154237 | 8/2009 |

OTHER PUBLICATIONS www.alpharubicon.com/prepinfo/LEDmamabear.htm, Energizer Folding LED light, printed Jul. 22, 2004.

www.ebay.com, Solar Car Emergency Light with Battery Charger, printed Jul. 22, 2004.

www.smarthome.com/9298.html, Flashlight, Radio and Charger Built inot One, printed Jul. 22, 2004.

www.ebay.com, 12V Porter Cable Battery Flashlight #869, printed Jul. 22, 2004.

http://shop.store.yahoo.com/toolsplus/d-adw908.html, 18 Volts Pivot Heavy Duty Flashlight, printed Jul. 22, 2004.

http://buy1.snapon.com/ . . . , Spotlight, Rechargeable, Halogen, Versa Volt, printed Jun. 17, 2004.

www.bennetts.com/garage/heating?categoryId=232, a variety of lighting devices, printed Jul. 22, 2004.

www.wildday.co.uk/ProductDetails.aspx?productId=103, Coleman Foldable Pocket Light, printed Jul. 22, 2004.

www.prairiecraft.com/ . . . , Ottlight Folding Table Light, printed Jul. 22, 2004.

www.save-on-crafts.com/dayligporlam.html, DayLight® Folding Task Lamp (U33050), printed Jul. 22, 2004.

www.onestopknifeshop.com/store/inova-x5mt-led-floodlight.html, INOVA X5MT LED Floodlight, printed Jul. 22, 2004.

www.solardyne.com/larsiglig.html, Large Sign Lighting Kits, printed Jul. 22, 2004.

www.bargainoutfitters.com/cb/cb.asp?a=43920, Guide Gear® 20 LED Floodlight, printed Jul. 22, 2004.

www.ewennyangling.co.uk/headlamps.htm, a variety of headlamps, printed Jul. 22, 2004.

www.webbikeworld.com/r2/optronics/, LED Headlamp Flashlight, printed Jul. 22, 2004.

www.streamlight-flashlights.com/slreledfl.html, SL-20XP™/LED/Halogen Flashlight, printed Jul. 22, 2004.

* cited by examiner

ELECTRICAL COMPONENT, SUCH AS A LIGHTING UNIT AND BATTERY CHARGER ASSEMBLY

RELATED APPLICATIONS

This patent application claims priority to prior-filed, co-pending U.S. Provisional Patent Application Ser. No. 60/667,147, filed Mar. 31, 2005, the entire contents of which is hereby incorporated by reference.

FIELD OF THE INVENTION

The present invention relates to electrical components, such as lighting units, and, more particularly, to a lighting unit, a battery charger, etc.

SUMMARY OF THE INVENTION

Lighting units, such as, for example, floodlights, are used on many job sites. A floodlight generally provides a wide area of illumination for the job site. A floodlight is typically supported on a surface during use (though it may be carried by a user at times). In contrast, a flashlight generally provides a comparably small area of illumination and is typically carried by a user during use (though it may be supported on a surface at times).

Many cordless products (e.g., cordless power tools, equipment, etc.) are also used on the job site. A battery charger (e.g., a power tool battery charger) and a lighting unit, such as, for example, a floodlight, as a single unit provides multiple functions in a single product.

Power outages may occur on a job site, and the sudden loss of visibility, due to the loss of an AC-powered light may cause a hindrance to work or movement around the job site. A lighting unit, such as, for example, a floodlight, which is selectively powered by AC power or by DC power (e.g., a battery pack, a power tool battery pack, etc.) may provide alternate lighting when the AC power source is unavailable (e.g., due to a power outage, due to an interruption in the supply of AC power, in an emergency situation, etc.).

In some independent aspects and in some constructions, a lighting unit, such as, for example, a floodlight, may generally include a light portion and a battery charging circuit for charging a power tool battery pack. The battery charging circuit may provide a trickle charge or a normal charge mode for the power tool battery pack, and the battery pack to be charged may selectively power the lighting unit. The lighting unit may include a status indicator for indicating, for example, the status of one or more batteries to be charged by the charging circuit.

In some independent aspects and in some constructions, an electrical component, such as, for example, a battery charger, includes a light, such as, for example, a floodlight, for illuminating a work area.

In some independent aspects and in some constructions, a lighting unit, such as, for example, a floodlight, may generally include a light portion which may selectively be powered by an AC power source or by a DC power source. A power tool battery pack may provide the DC power source to selectively power the light portion. The DC power source may supply power to the light portion when the AC power source is unavailable (e.g., due to a power outage, due to an interruption in the supply of AC power, in an emergency situation, etc.).

In such constructions, the lighting unit may include a battery support portion on which a battery is supported. In some constructions, the battery may be releasably locked to the battery support portion.

In such constructions, the lighting unit may include a power selector to select the power mode to power the light portion. The power mode selector may include a controller which controls the selection of a power mode for the lighting unit between an AC power mode and a DC power mode. The controller may automatically select the DC power mode when the AC power source is unavailable (e.g., due to a power outage, due to an interruption in the supply of AC power, in an emergency situation, etc.). The controller may selectively control charging of one or more battery packs connected to a charging circuit.

In some constructions, the lighting unit may include a pass-through plug or outlet on a portion of the lighting unit (e.g., on the base housing, on the AC power cord, etc.).

In some constructions, the lighting unit may include a battery-powered flashlight providing the light portion which is selectively powered by the DC power source. The lighting unit may include a charging assembly for charging the battery in the battery-powered flashlight. The flashlight may be removable from the lighting unit.

In some independent aspects and in some constructions, a lighting unit, such as, for example, a floodlight, may generally include a light portion having a high-watt light source, which is powered by an AC power source, and a low-watt light source, which is powered by a DC power source. The high-watt light source may include a halogen light source. The low-watt light source may be powered by the DC power source when the AC power source is unavailable (e.g., due to a power outage, due to an interruption in the supply of AC power, in an emergency situation, etc.).

In some independent aspects and in some constructions, a lighting unit, such as, for example, a floodlight, may generally include a light portion including a LED light source, and the LED light source may be selectively powered by an AC power source or by a DC power source. The LED light source may be a relatively low-watt light source which may be powered by a DC power source (e.g., a power tool battery pack) for a relatively long time.

In some independent aspects and in some constructions, a lighting unit, such as, for example, a floodlight, may generally include a light portion including a light source and a light housing and a base portion including a base housing. The light housing may be movable (e.g., pivotable) relative to the base housing between a closed position, in which the light source is at least partially covered by the base housing, and an open position. The lighting unit may include a light source supported on a head which is pivotable relative to a housing (e.g., the light housing, the base housing, etc.). The head may be pivotable about a single axis or about multiple axes.

In such constructions, the lighting unit may include a position fixing arrangement, such as a detent arrangement, for releasably holding the light housing in a selected position relative to the base housing. The lighting unit may include a locking assembly for releasably holding the light housing in a selected position (e.g., in a closed position) relative to the base housing.

A handle may be provided to carry the lighting unit to, from and around a worksite. The handle may provide a protective structure to protect a portion of the lighting unit, such as, for example, the light portion, a battery charger portion, a battery, etc. The lighting unit may include a separate protective structure, such as a protective bar, for protecting a portion of the lighting unit.

In some independent aspects and in some constructions, a lighting unit, such as, for example, a floodlight, may be constructed to be a heavy-duty, durable lighting unit for use on a job site. The lighting unit may be constructed to withstand impacts which may occur on a job site. In some constructions, the lighting unit may include another electrical component such as, for example, an audio component. In some constructions, the lighting unit may include an internal power source, such as, for example, a generator, a supply battery, etc.

In some independent aspects and in some constructions, a lighting unit, such as, for example, a floodlight, may be selectively mounted or supported on various surfaces, such as, for example, supported on a horizontal work surface, hung from a substantially vertical wall or support, supported on a separate frame or stand, etc. The lighting unit may include a telescoping support assembly for adjusting the height of a light portion relative to a housing (e.g., a light housing, a base housing, a separate frame or stand, etc.).

In such constructions, the lighting unit may include connecting structure for releasably connecting the lighting unit to a support. Such connecting structure may be similar to a Clip-Lok™ system provided for power tools, accessories, etc.

In some independent aspects and in some constructions, a lighting unit, such as, for example, a floodlight, may include a storage compartment for storing tools, extra bulbs for the light portion, etc.

One or more independent features and independent advantages are set forth in the following detailed description.

Figure 1:
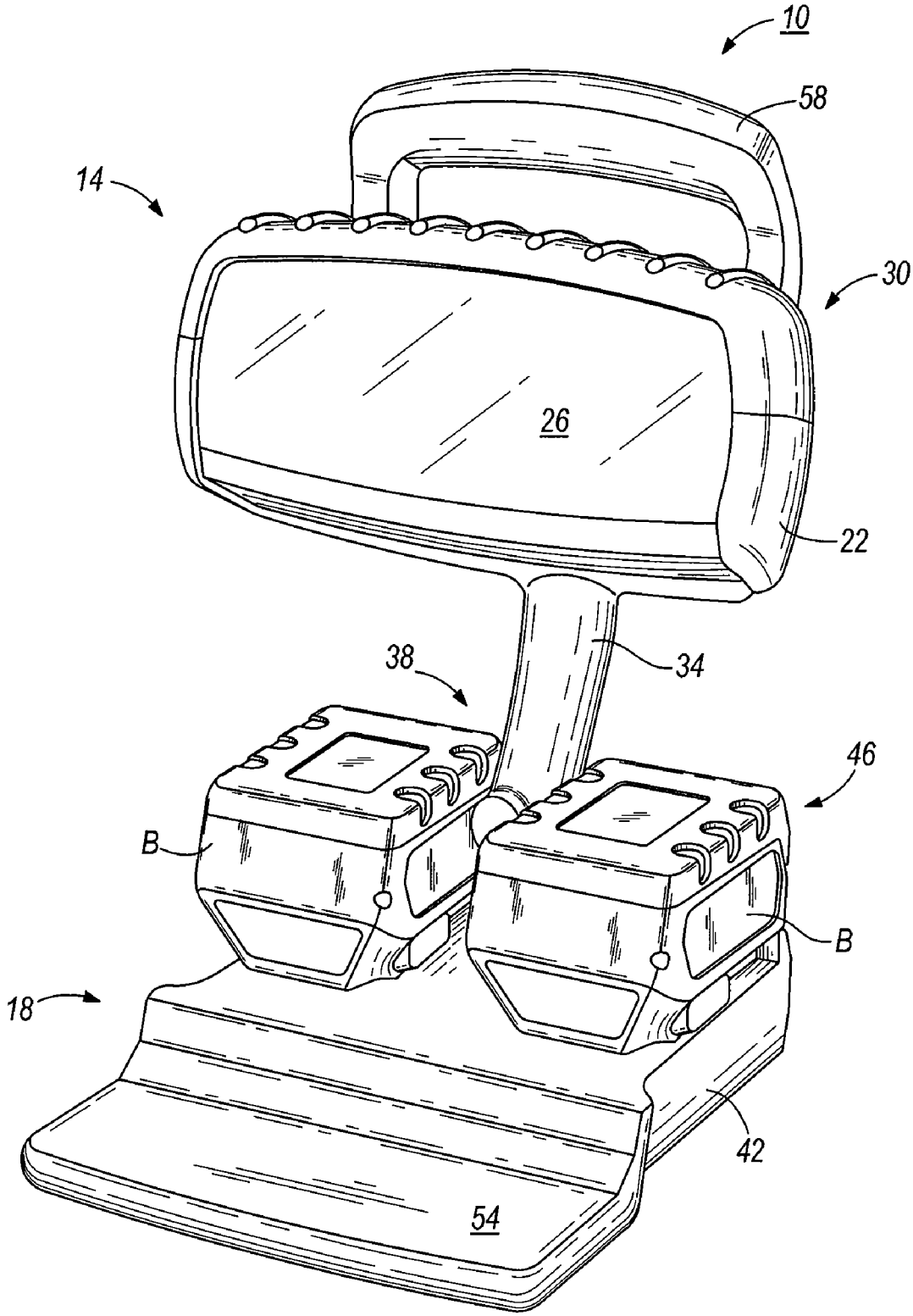
FIG. 1 is a perspective view of a lighting unit, illustrating a light portion in an open condition.

Before at least one embodiment of the invention is explained in detail, it is to be understood that the invention is not limited it its application to the details of the construction and the arrangements of the components set forth in the following description or illustrated in the drawings. The invention is capable of other embodiments and of being practices or carried out in various ways. In addition, it is understood that the phraseology and terminology used herein is for the purpose of description and should not be regarded as limiting.

The use of "including", "comprising", or "having" and variations thereof herein is meant to encompass the items listed thereafter and equivalents thereof as well as additional items. Unless limited otherwise, the terms "connected", "coupled" and variations thereof herein are used broadly to encompass direct and indirect connections and couplings. In addition, the terms "connected" and "coupled" and variations thereof are not restricted to physical or mechanical connections or couplings.

DETAILED DESCRIPTION

Figure 2:
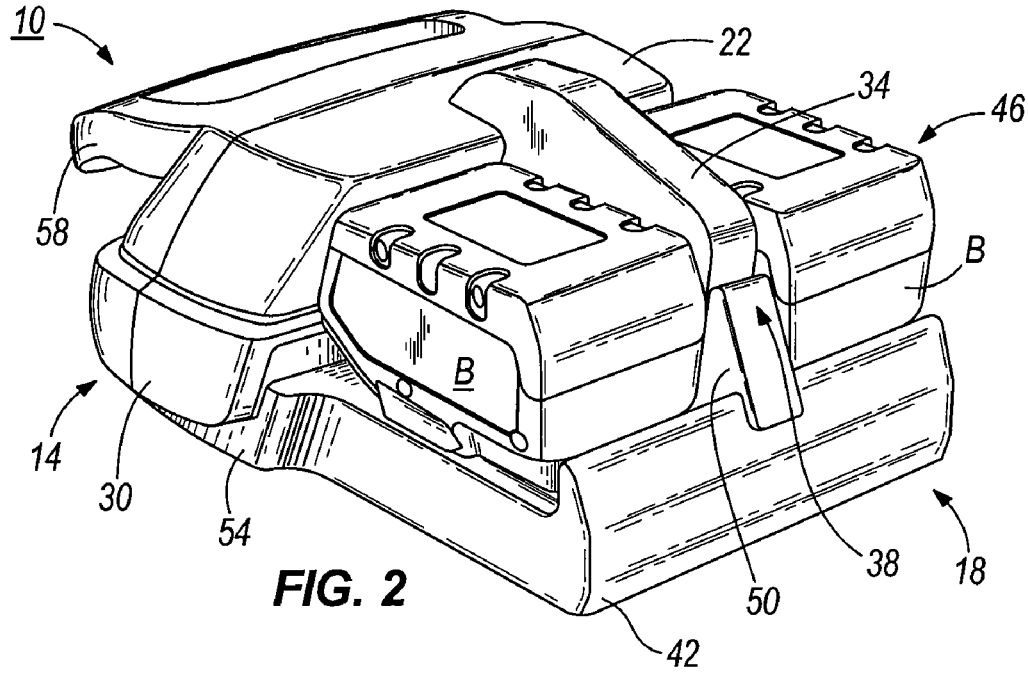
FIG. 2 is a perspective view of the lighting unit shown in FIG. 1, illustrating the light portion in a closed condition.
Figure 3:
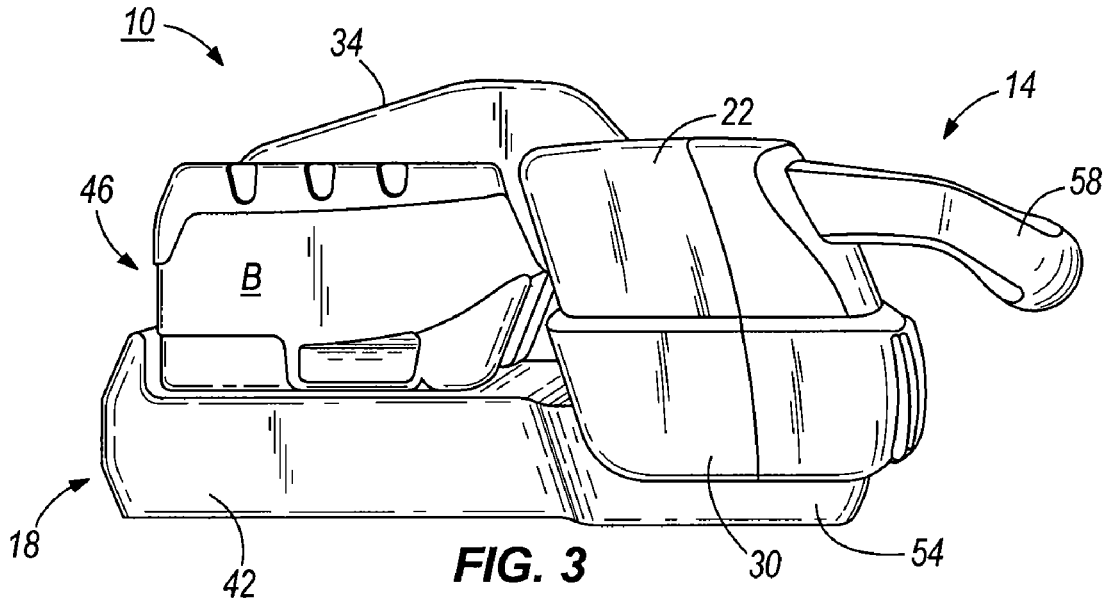
FIG. 3 is a side view of the lighting unit shown in FIG. 1, illustrating the light portion in the closed condition.

FIGS. 1-3 illustrate a lighting unit 10 embodying one or more independent aspects of the invention. In some independent aspects and in some constructions, the lighting unit 10 is a floodlight. In some independent aspects and in some constructions, the lighting unit 10 includes a battery charging circuit for charging a battery such as, for example, a power tool battery pack B. In some constructions and in some independent aspects, the lighting unit 10 is selectively powered by an AC power source (e.g., line power) or by a DC power source (e.g., the battery pack B).

In some constructions, the lighting unit 10 is constructed to be a heavy-duty, durable lighting unit 10 for use on a job site. The lighting unit 10 may be constructed to withstand impacts which may occur on a job site.

In the illustrated construction, the battery pack B is a slide-on power tool battery pack having a voltage of, for example, between 9.6V (or lower) and 40V (or higher). A similar battery pack is illustrated and described in U.S. patent application Ser. Nos. 10/720,027, filed Nov. 20, 2003; Ser. No. 10/721,800, filed Nov. 24, 2003; and Ser. No. 10/719,680, filed Nov. 20, 2003; the entire contents of all of which are hereby incorporated by reference.

The lighting unit 10 generally includes a light portion 14 supported by a base portion 18. The light portion 14 includes a light housing 22 supporting a light assembly, illuminating portion or light source 26. In the illustrated construction, the light housing 22 is movably supported relative to the base portion 18. In the illustrated construction, the light housing 22 is pivotable relative to the base portion 18 between an open position (shown in FIG. 1) and a closed position (shown in FIGS. 2-3).

In some independent aspects and in some constructions, the light source 26 is selectively powered by one power source (e.g., an AC power source (line power)) or by another power source (e.g., a DC power source (a battery pack B)). The light source 26 may be powered by the DC power source when the AC power source is unavailable (e.g., due to a power outage, due to an interruption in the supply of AC power, in an emergency situation, etc.).

In some constructions, such as the illustrated construction, the light portion 26 includes a single type of light source which is selectively powered by both an AC power source and a DC power source. Such a light source 26 may be a LED light source or lighting element, which is a relatively low-watt light source. Such a low-watt light source may be powered for some time by a single charge of a battery pack B.

In other constructions, the light source 26 may include a high-watt light source or lighting element (e.g., a halogen light source) which is powered by a high-capacity power source (e.g., line power) and a separate low-watt light source or lighting element (e.g., a LED light source) which is powered by a lower-capacity power source (e.g., a battery pack B).

In some constructions, the low-watt light source and the DC power source may be provided by a battery-powered flashlight (not shown). The lighting unit 10 may include a charging assembly for charging the battery in the battery-powered flashlight. The flashlight may be powered when the AC power source is unavailable (e.g., due to a power outage, due to an interruption in the supply of AC power, in an emergency situation, etc.) and may be removable from the lighting unit 10.

In still other constructions, the light source 26 may include a single high-watt light source (e.g., a halogen light source) which may be powered by both an AC power source and a DC power source. In such constructions, the DC power source (e.g., a battery pack B) may only be able to supply power to the high-watt light source for a relatively short period of time before the battery pack B is discharged.

The light housing 22 includes a head portion 30, which supports the light source 26, and an arm portion 34, which is movably connected to the base portion 18. A pivot assembly 38 pivotably connects the arm portion 34 to the base portion 18. In the illustrated construction, the pivot assembly 38 provides relative movement between the arm portion 34 and the base portion 18 about a single generally horizontal axis. In other constructions (not shown), the pivot assembly 38 may provide relative movement between the arm portion 34 and the base portion 18 about multiple axes (e.g., a first generally horizontal axis, a second generally horizontal axis and/or a generally vertical axis, etc.).

In the illustrated construction, the head portion 30 is fixed to and movable with the arm portion 34. In other constructions (not shown), the head portion 30 may be movable (e.g., pivotable) relative to the arm portion 34 to further adjust the orientation of the light source 26 relative to the base portion 18. In such constructions, the head portion 30 may be pivotable relative to the arm portion 34 about a single axis (e.g., horizontal, vertical, etc.) or about multiple axes (e.g., horizontal and vertical, multiple horizontal, etc.).

Figure 5:
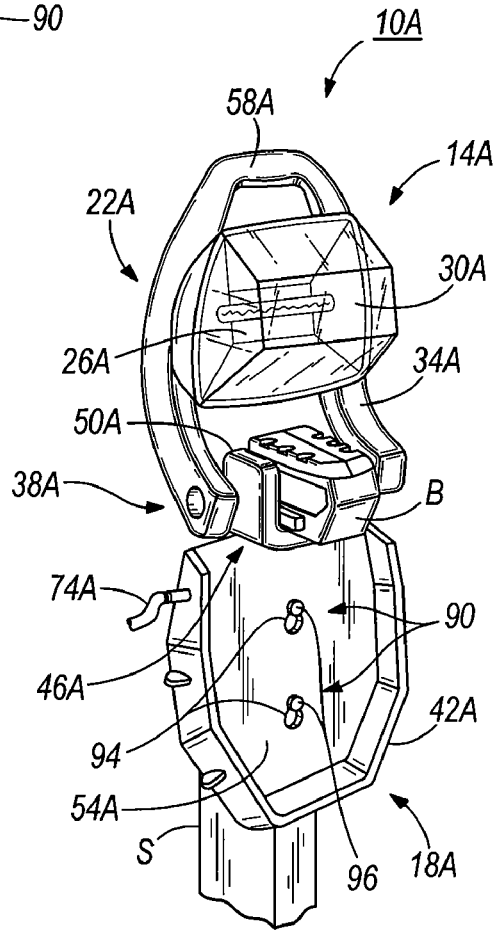
FIG. 5 is a perspective view of the lighting unit shown in FIG. 4, illustrating the light portion in a second open condition.
Figure 7:
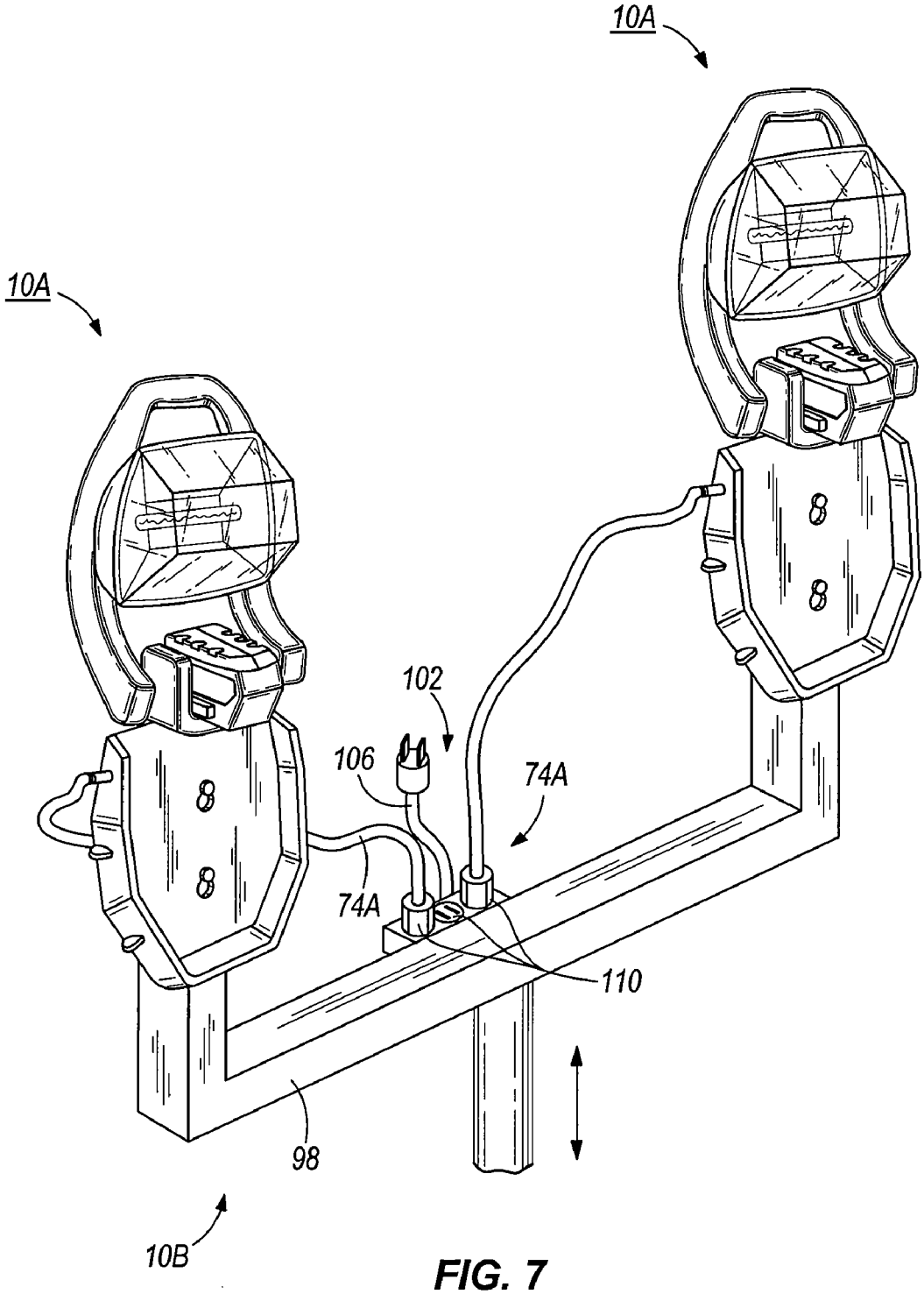
FIG. 7 is another alternate construction of a lighting unit, illustrating a lighting unit supported on a stand.

The base portion 18 includes a base housing 42 which, in the illustrated construction, is supported on a surface such as, for example, a work surface, a floor, etc. While, in the illustrated construction, the housing 42 is illustrated supported on a substantially horizontal surface, in other constructions, the housing 42 may be supported on a substantially vertical surface (e.g., hung from a wall or support S (as shown in FIG. 5)) or on a separate stand (as shown in FIG. 7) which is supported on a surface.

In the illustrated construction, at least the housing 42 is constructed to be durable and to withstand impacts which may occur on a job site. The housing 42 may be blow-molded and may include structure and materials to improve durability while maintaining an acceptable weight. The material and construction of the housing 42 may also provide heat resistance and/or heat dissipation for electrical components internal to the housing 42 (e.g., an electrical circuit, a battery charging circuit, etc.) and for other electrical components which may be positioned in proximity to the housing 42 (e.g., the light source 26 (when positioned in a closed position), the battery B, etc.).

The base portion 18 provides a sufficient base (e.g., area, weight, etc.) to support the lighting unit 10 in a stable condition when the light portion 14 is in an open position. In the illustrated construction, the base portion 18 includes a battery section 46 on which one or more batteries or battery packs B are supportable for use as a DC power source for the light source 26 and/or for charging.

A base arm 50 extends upwardly from the base portion 18. The arm portion 34 is pivotably connected to the base arm 50. In the illustrated construction, the base arm 50 is between adjacent battery packs B.

A section 54 extends forwardly of the battery support section 46. The section 54 provides a recessed area into which at least a portion of the light housing 22 and the light source 26 is positionable in the closed position (see FIGS. 2-3). The section 54 covers at least a portion of the light housing 22 and the light source 26 in the closed position. The section 54 may provide protection to at least a portion of the light source 26 in the closed position, for example, protecting the light source 30 from impacts during transport of the lighting unit 10 to, from and around a job site. The section 54 may be formed of impact resistant material and/or have an impact resistant structure (e.g., honeycomb cross-section). The section 54 may also be formed of heat resistant material and/or have a heat resistant structure (e.g., air flow passages) to resist and/or dissipate any heat generated by, for example, the light source 26.

A handle 58 is connected to the lighting unit 10 and may be used to move the lighting unit 10 to, from and around the job site. In the illustrated construction, the handle 58 is connected to the light housing 22 and may be used to move the light housing 22 relative to the base housing 22.

The handle 58 may also provide a protective structure for a portion of the lighting unit 10, such as, for example, the light assembly 30, a battery B connected to the lighting unit 10, the battery support section 46, etc. In other constructions (not shown) a separate protective structure such as, for example, a protective bar or wall may be provided. Such protective structure is described and illustrated in U.S. patent application Ser. No. 10/291,868, filed Nov. 8, 2002; Ser. No. 10/289,621, Nov. 7, 2002; and Ser. No. 10/840,703, filed May 6, 2004; the entire contents of all of which are hereby incorporated by reference.

A position fixing arrangement (not shown) may be provided between the light housing 22 and the base portion 18 to hold the light housing 22 is a selected position relative to the base portion 18. Such a position fixing arrangement may include detent arrangement (not shown) including a projection (not shown) on one of the light housing 22 and the base housing 42 which is engageable in a recess (not shown) on the other of the light housing 22 and the base housing 42 corresponding to a selected position of the light housing 22 relative to the base housing 42 to retain the light housing 22 in that selected position. A plurality of recesses (not shown) each of which correspond to a selected position of the light housing 22 relative to the base housing 42 (e.g., a closed position, a first open position, a second open position between the closed position and the first open position, etc.) may be provided, and the projection may be engaged in one of the recesses to retain the light housing 22 in the selected position relative to the base housing 42.

A biasing member (not shown) may be provided to bias the projection into an engaged position with a selected recess. The force of the biasing member may be overcome by a user applying force to a portion of the lighting unit 10 (e.g., to the light housing 22) to move the light housing 22 relative to the base housing 42 from a selected position.

In other constructions, an actuator (not shown) may be provided to move the projection out of engagement with a selected recess. Such an actuator may be a knob, a lever, etc. which is operable by a user to enable the user to move the projection out of engagement with the selected recess to then allow the user to move the light housing 22 relative to the base housing 42.

A locking arrangement (not shown) may be provided to lock (e.g., by positive engagement, by frictional engagement, by combination positive/frictional engagement, etc.) the light housing 22 in a position relative to the base housing 42, such as, for example, in a closed position, in an open position). The locking arrangement may include inter-engaging locking members (not shown but similar to the members of the detent arrangement) which are positively engageable to retain the light housing 22 in the selected position relative to the base housing 22. The locking arrangement may include one or more frictional or clamping locking members (not shown) which provide a frictional or clamping force to retain the light housing 22 in the selected position relative to the base housing 42. An actuator may be provided to disengage the locking member(s) to allow movement of the light housing 22 relative to the base housing 42 from the locked position.

In some constructions, the lighting unit 10 may include another electrical component (not shown) such as, for example, an audio component. In some constructions, the lighting unit 10 may include an internal power source (not shown), such as, for example, a generator, a supply battery, etc. In some constructions, the lighting unit 10 may include a storage compartment (not shown) for storing tools, extra bulbs for the light portion, etc.

Figure 8:
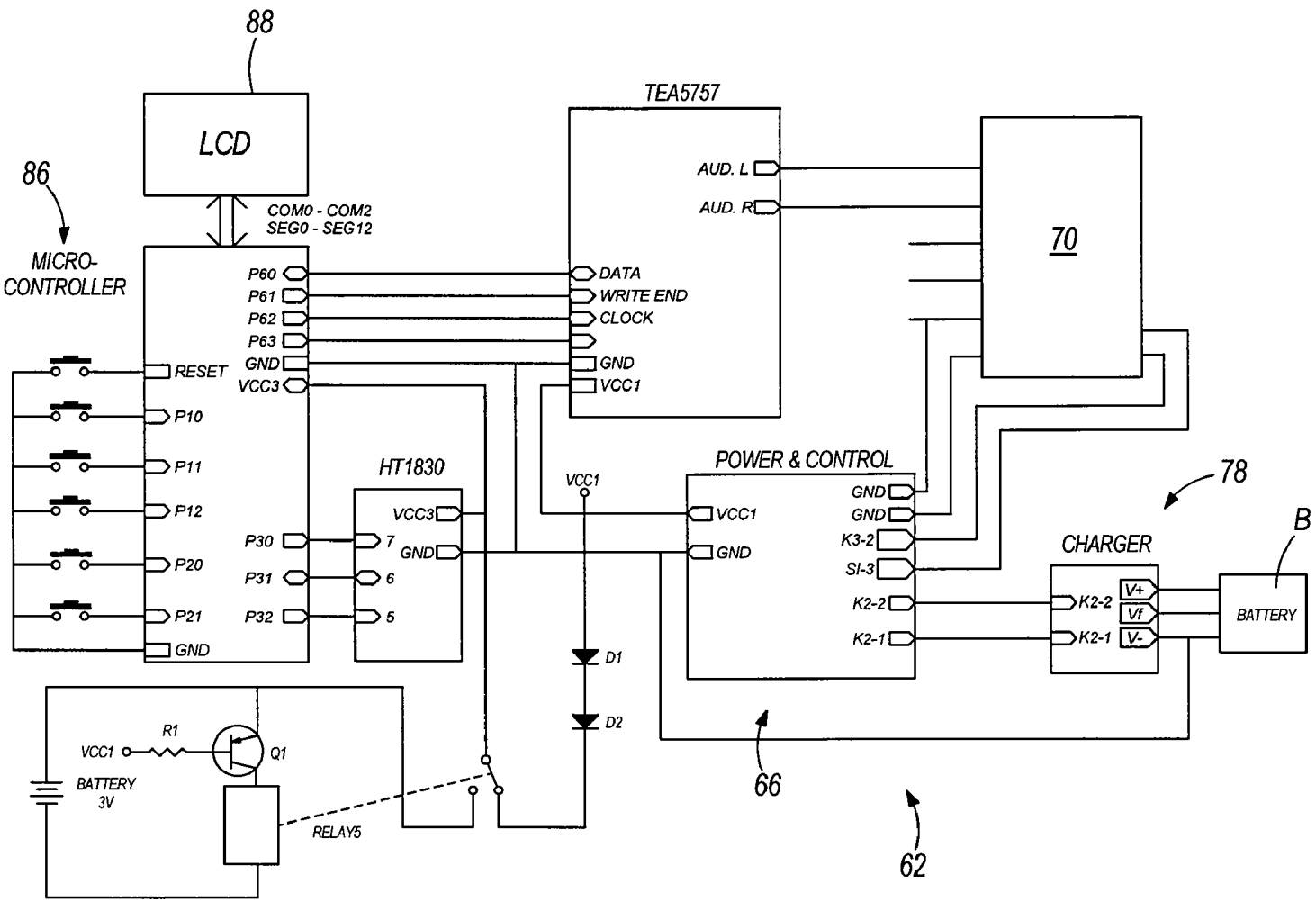
FIG. 8 is schematic diagram of an electrical circuit for a lighting unit.
Figure 9:
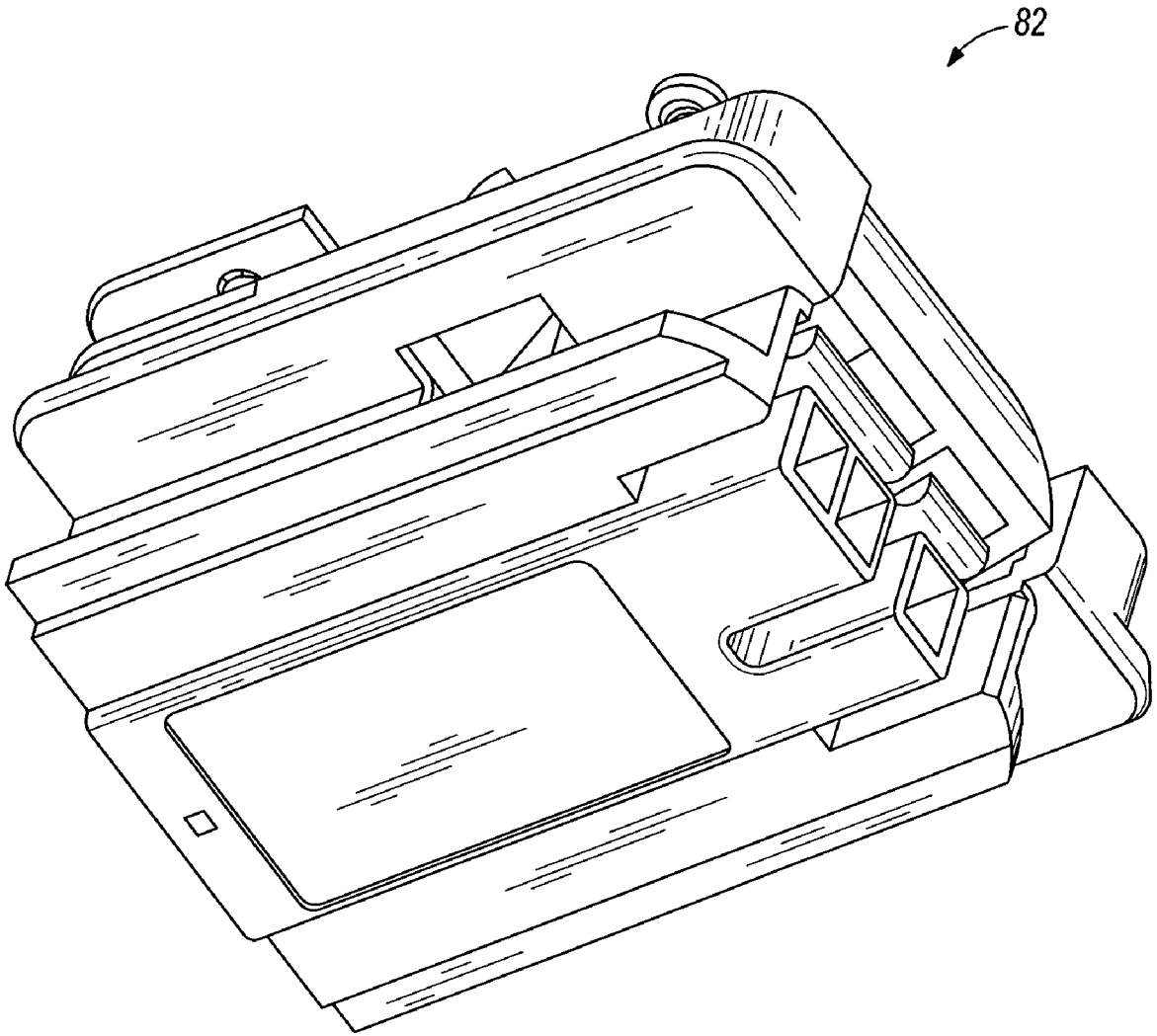
FIG. 9 is a perspective view of a battery support portion of a lighting unit.
Figure 10C:
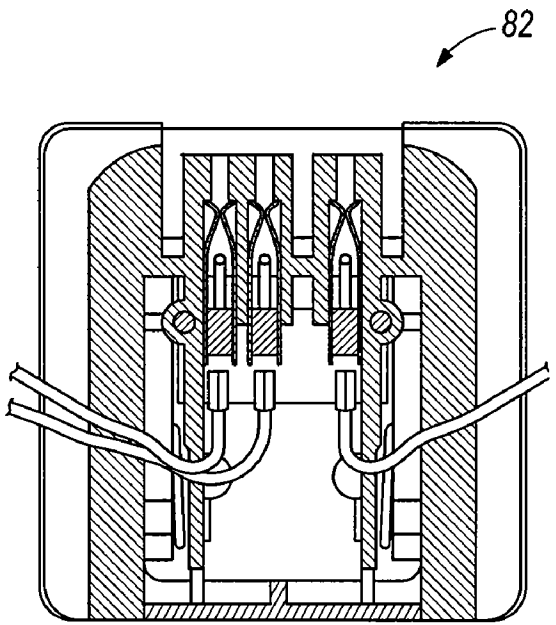
FIGS. 10A-10C are views of the battery support portion shown in FIG. 9.
Figure 10B:
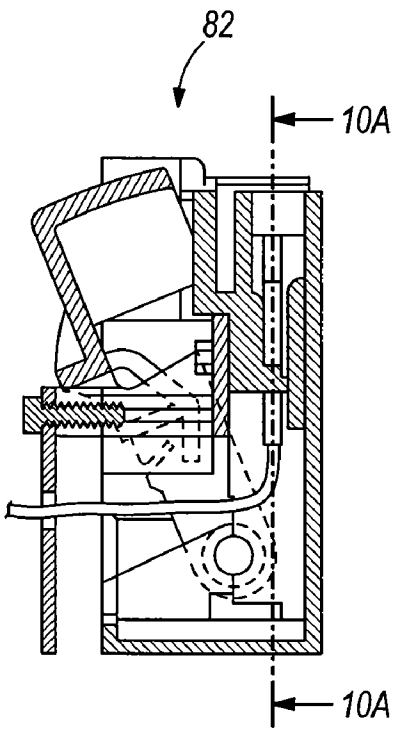
Figure 10A:
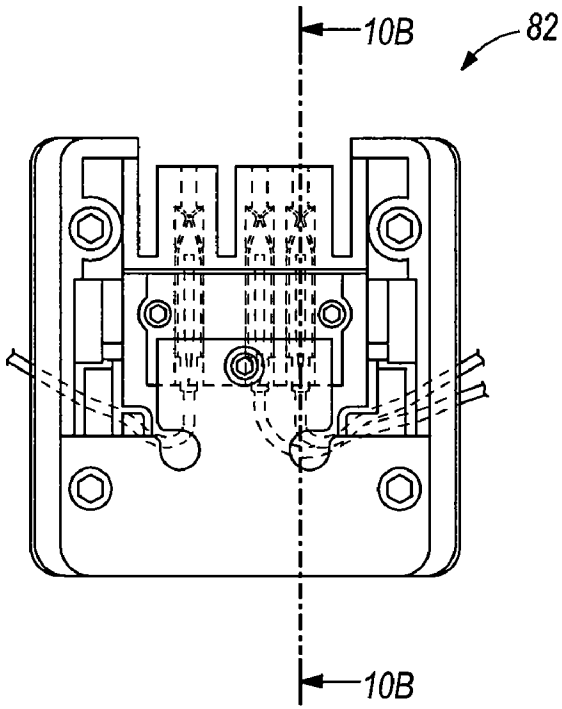

As shown in FIG. 8, the lighting unit 10 includes an electrical circuit 62. A portion 66 of the electrical circuit is supported by the base housing 42. An operational electrical circuit or light electrical circuit portion 70 is supported by the light housing 26. A power cord 74 is electrically connected and may provide power to the electrical circuit 66. The power cord 74 may connect the electrical circuit to an AC power source (e.g., line power). The lighting unit 10 may include a pass-through outlet (not shown but similar to outlet 110) on a portion of the lighting unit 10 (e.g., on the base housing 42, on the AC power cord 74, etc.).

In some independent aspects and in some constructions, the electrical circuit 62 includes a charging circuit 78 which is operable to charge one or more batteries, such as, for example, a battery pack B. The charging circuit may be any charging circuit which is suitable for charging the associated battery, such as a battery pack B. Suitable charging circuits are described and illustrated in U.S. Pat. No. 6,222,343, issued Apr. 24, 2001; U.S. Pat. No. 6,456,035, issued Sep. 24, 2002; U.S. Pat. No. 6,605,926, issued Aug. 12, 2003; and U.S. patent application Ser. No. 10/638,712, filed Aug. 11, 2003, the entire contents of all of which are hereby incorporated by reference. Other suitable charging circuits are described in U.S. patent application Ser. Nos. 10/291,868; 10/289,621; and 10/840,703; mentioned above.

As shown in FIGS. 9 and 10A-10C, a port 82 is provided to connect the battery pack B to the lighting unit 10. In the illustrated construction, two ports 82 are provided on the battery section 46 of the base housing 42. In the illustrated construction, each port 82 is operable to support an associated battery pack B on the lighting unit 10 and to electrically connect the associated battery pack B to the electrical circuit 62. In some constructions, such as the illustrated construction, each port 82 electrically connects the associated battery pack B to the charging circuit 78 such that each battery pack B is chargeable by the charging circuit 78. In some constructions, such as the illustrated construction, each port 82 electrically connects the associated battery pack B to the light electrical circuit portion 70 such that each battery pack B may selectively supply power to the light source 26.

Each battery pack B is removably connectable to the associated port 82. The battery pack B and the port 82 include complementary structure for mechanically connecting the battery pack B to the port 82 and for electrically connecting the battery pack B to the electrical circuit 66 of the lighting unit 10. Each port 82 may be similar to the port described and illustrated in U.S. patent application Ser. Nos. 10/291,868; 10/289,621; and 10/840,703, mentioned above.

In some constructions, the battery pack B may be removably locked to the port 82 so that the battery pack B will be retained on the port 82 absent some action by the user. For example, the battery pack B and the port 82 may include inter-engaging locking members (not shown) which retain the battery B on the port 82 and an actuator (not shown) which is engageable by the user to disengage the locking members. Such locking members and actuator may similar to the locking members and actuators provided by the battery pack B and a power tool.

As shown in FIG. 8, in some constructions, the electrical circuit 62 of the lighting unit 10 includes a controller 86. In some constructions, such as the illustrated construction, the controller 86 is operable to control charging of the battery pack(s) B. The controller 86 may communicate with the battery pack(s) B to determine the state of charge or other information from the battery pack B. The controller 86 may then operates to control the charging circuit 78 to charge the battery pack(s) B.

In some constructions, such as the illustrated construction, the controller 86 is operable control a power selection mode for the lighting unit 10. If the lighting unit 10 is connected to an AC power source (e.g., line power) and to a DC power source (e.g., a battery pack B), the controller 58 may select the appropriate power source for powering the lighting unit 10 and/or the light source 26.

For example, when the AC power source is unavailable (e.g., due to a power outage, due to an interruption in the supply of AC power, in an emergency situation, etc.), the controller 86 may operate to select the DC power mode so that power is supplied from the DC power source (e.g., the battery pack(s) B) to the electrical circuit 66 and/or to the light electrical circuit portion 70 and to the light source 26. If more than one battery pack B is provided, the controller 86 may determine from which battery pack B power is to be supplied and/or whether more than one battery pack B is selected to supply power.

An indicator 88 is provided for communicating the status of at least a portion of the lighting unit 10 to a user. In some constructions, such as the illustrated construction, the indicator 88 may indicate the charging status, the charging mode, etc. of the charging circuit 78. In some constructions, the indicator 88 may indicate to the user the state of charge of or other information from each battery pack B. In some constructions, the indicator 88 may indicate the power mode (e.g., "Power Off", AC power, DC power, etc.) of the lighting unit 10.

FIGS. 3-6 illustrate an alternative construction for a lighting unit 10A. Common elements are identified by the same reference number "A".

Figure 4:
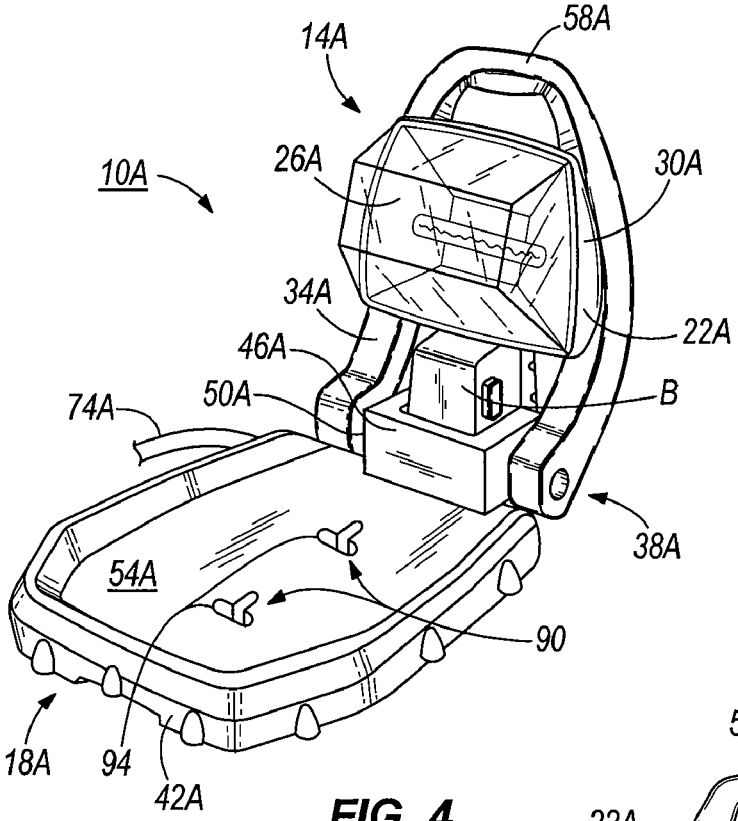
FIG. 4 is a perspective view of another construction of a lighting unit, illustrating the light portion in a first open condition.
Figure 6:
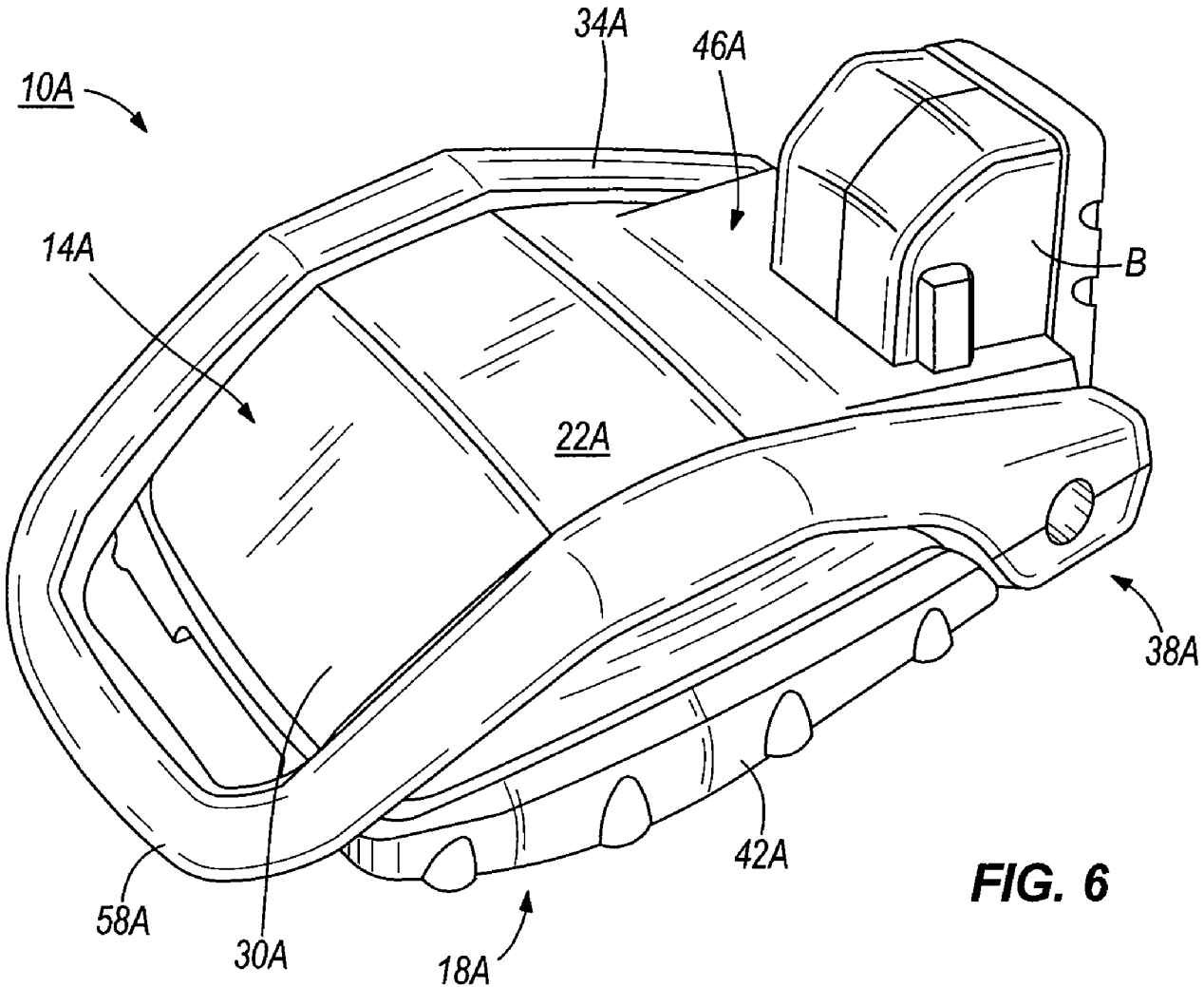
FIG. 6 is a perspective view of the lighting unit shown in FIG. 4, illustrating the light portion in a closed condition.

As shown in FIGS. 4-6, the light housing 22A may be movable between several positions relative to the base housing 42A. As shown in FIG. 4, the light housing 22A may be positioned in an intermediate open position in which the base housing 42A is supported on a substantially horizontal surface (e.g., a work surface, the floor, etc.). As shown in FIG. 5, the light housing 22A may be positioned in a fully-opened position in which the base housing 42A is supported by or connected to a substantially vertical surface (e.g., hung on a wall or support S). As shown in FIG. 6, the light housing 22A may be moved to a closed position relative to the base housing 42A.

As shown in FIGS. 4-6, in the illustrated construction, the handle 58A provides the arm portion 34A. The arm portion 34A may provide a protective structure for a portion of the lighting unit 10A, such as, for example, the light source 26A, the battery B, etc.

As shown in FIGS. 4-5, the lighting unit 10A includes connecting structure 90 for selectively connecting the lighting unit 10A to a support. In the illustrated construction, the connecting structure 90 includes one or more openings 94 defined by the base housing 42A which are engageable with projections 96 on a support. The connecting structure 90 may be similar to that described and illustrated in U.S. patent application Ser. No. 10/389,070, filed Mar. 14, 2002, the entire contents of which are hereby incorporated by reference.

FIG. 7 illustrates another alternative construction of a lighting unit 10B. Common elements are identified by the same reference number "B".

In the illustrated construction, the lighting unit 10B includes a pair of lighting units, such as lighting units 10A, which are connected to a frame 98. The frame 98 may be adjustable to adjust the height, position, orientation, etc. of the lighting units 10A.

The lighting unit 10B includes an electrical circuit 102. The electrical circuit 102 includes a power cord 106 for connecting the electrical circuit 102 to a power source (e.g., an AC power source, such as line power) and outlets 110 for connecting the power cord 74A of each lighting unit 10A to the power source. Additional pass-through outlets 110 may be provided to connect other electrical equipment (e.g., a radio, a battery charger, a corded power tool, etc.) to the power source.

Figure 11:
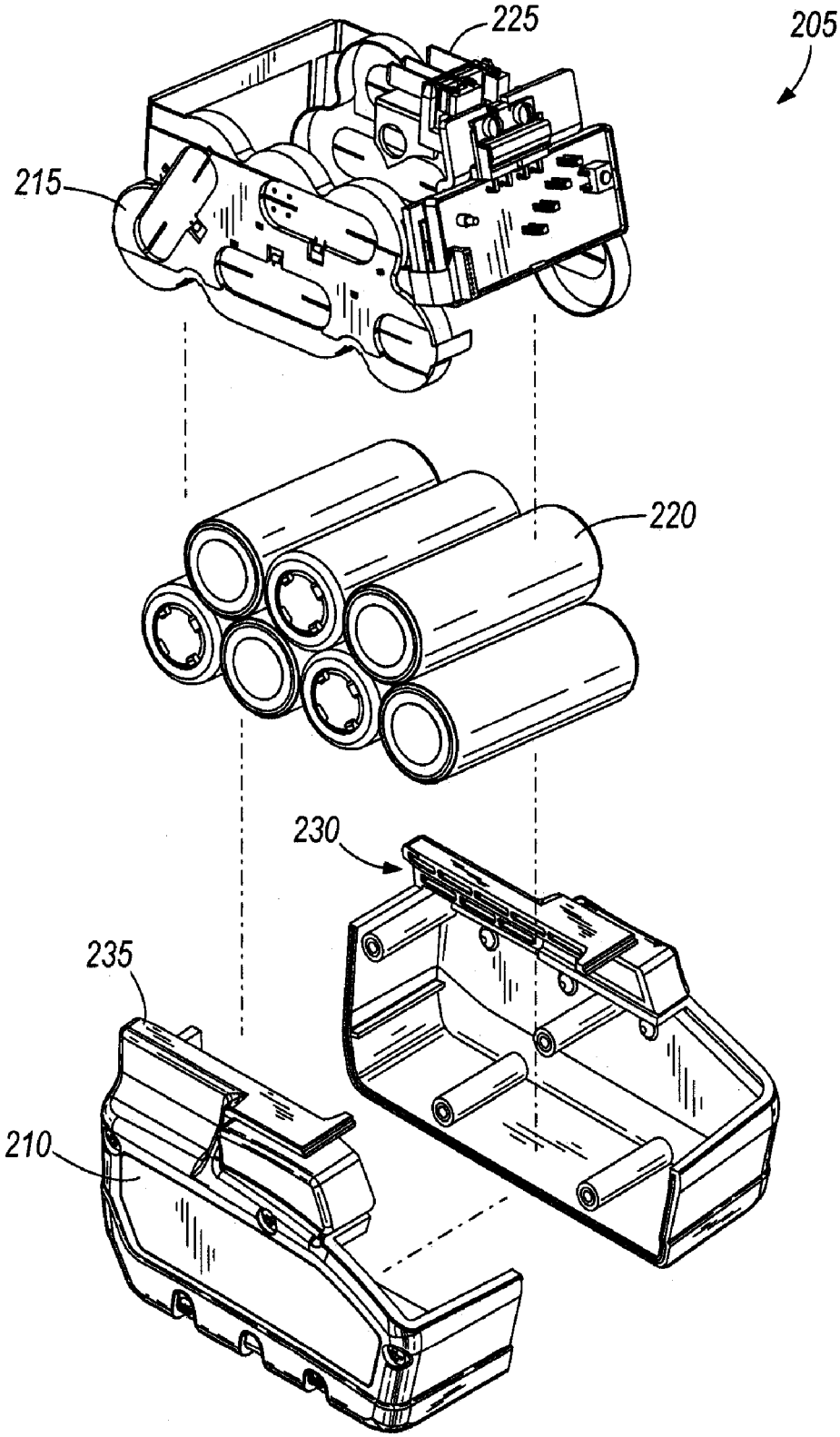
FIG. 11 is an exploded view of a battery including a housing and a plurality of cells.

FIG. 11 illustrates one possible battery pack 205 suitable for use with the device illustrated in FIGS. 1-7. The battery pack 205 includes a battery housing 210 that provides a battery support portion 215. A plurality of cells 220 is supported by the battery support portion 215, and a battery terminal 225 is electrically connected with the plurality of cells. The housing 210 provides a battery port 230 that includes a housing support portion 235 that is engageable with the battery support portion 215 to support the plurality of cells 220 in the housing 210.

Although the invention has been described in detail with reference to certain preferred embodiments, variations and modifications exist within the scope and spirit of one or more independent aspects of the invention as described.

What is claimed is:

1. A light comprising:

a light body including an illuminating portion;

a housing operable to support the light body such that the light body is movable with respect to the housing between an open position and a closed position in which the illumination portion is protected by the housing, the housing being operable to support a removable power tool battery pack external to the housing; and an operational circuit supported by the housing, the operational circuit being electrically connectable between the illuminating portion and the battery pack and a second power source such that power is suppliable to the illuminating portion from each of the battery pack and the second power source, the second power source being different from the battery pack.

2. The light of claim 1, wherein the light includes a floodlight, wherein the housing includes a base operable to support the floodlight on a surface.

3. The light of claim 1, wherein the battery pack includes a battery housing providing a battery support portion, a cell supported by the battery support portion, and a battery terminal electrically connected with the cell, wherein the battery housing provides a battery port including a housing support portion engageable with the battery support portion to support the battery pack on the housing, wherein the circuit includes a circuit terminal supported by the battery port and electrically connectable with the battery terminal to electrically connect the battery pack to the circuit.

4. The light of claim 1, and further comprising a power cord electrically connected to the circuit and operable to connect the circuit to the second power source.

5. The light of claim 4, wherein the power cord is operable to connect the circuit to an AC power source.

6. The light of claim 1, wherein the illuminating portion includes a first lighting element and a second lighting element different than the first lighting element, wherein the circuit is electrically connected to the first lighting element and to the second lighting element and is operable to supply power from the battery pack to the first lighting element and to supply power from the second power source to the second lighting element.

7. The light of claim 6, wherein, when the second power source supplies power to the second lighting element, the circuit operates to not supply power from the battery pack to the first lighting element.

8. The light of claim 6, wherein, when a supply of power from the second power source to the second lighting element is interrupted, the circuit operates to supply power from the battery pack to the first lighting element.

9. The light of claim 6, wherein one of the first lighting element and the second lighting element includes a LED lighting element.

10. The light of claim 9, wherein the first lighting element includes the LED lighting element, and wherein the second lighting element includes a high-watt lighting element.

11. The light of claim 1, wherein the circuit includes a battery charging circuit portion electrically connectable between the battery pack and the second power source such that power is suppliable from the second power source to the battery pack to charge the battery pack.

12. A light comprising:

a light body including an illuminating portion;

a housing operable to support the light body such that the light body is movable between a plurality of operating positions with respect to the housing, the housing being operable to support a removable power tool battery pack, the battery pack being removable from the housing by hand without any disassembly; and an operational circuit supported by the housing, the operational circuit being electrically connectable between the illuminating portion, an external power source, and the battery pack such that power is selectively suppliable to the illuminating portion directly from one of the external power source and the battery pack, the circuit including a battery charging circuit portion electrically connectable between the battery pack and the power source such that power is suppliable from the power source to the battery pack to charge the battery pack.

13. The light of claim 12, wherein the operational circuit is electrically connectable between the illuminating portion and the power source such that power is suppliable to the illuminating portion from the power source.

14. The light of claim 13, wherein the illuminating portion includes a first lighting element and a second lighting element different than the first lighting element, wherein the circuit is electrically connected to the first lighting element and to the second lighting element and is operable to supply power from the battery pack to the first lighting element and to supply power from the power source to the second lighting element.

15. The light of claim 14, wherein, when the power source supplies power to the second lighting element, the circuit operates to not supply power from the battery pack to the first lighting element.

16. The light of claim 14, wherein, when a supply of power from the power source to the second lighting element is interrupted, the circuit operates to supply power from the battery pack to the first lighting element.

17. The light of claim 14, wherein one of the first lighting element and the second lighting element includes a LED lighting element.

18. The light of claim 17, wherein the first lighting element includes the LED lighting element, and wherein the second lighting element includes a high-watt lighting element.

19. The light of claim 12, wherein the light includes a floodlight, wherein the housing includes a base operable to support the floodlight on a surface.

20. The light of claim 12, wherein the battery pack includes a battery housing providing a battery support portion, a cell supported by the battery housing, and a battery terminal electrically connected with the cell, wherein the housing provides a battery port including a housing support portion engageable with the battery support portion to support the battery pack on the housing, wherein the circuit includes a circuit terminal supported by the battery port and electrically connectable with the battery terminal to electrically connect the battery pack to the circuit.

21. The light of claim 12, and further comprising a power cord electrically connected to the circuit and operable to connect the circuit to the power source.

22. A floodlight comprising:

a light body including an illuminating portion, the illuminating portion including a first lighting element and a second lighting element different than the first lighting element;

a housing operable to support the light body such that the light body is movable with respect to the housing to a closed position in which the housing covers the illumination portion, the housing including a base operable to support the floodlight on a surface, the housing being operable to support a removable power tool battery pack external to the housing, the battery pack including a battery housing providing a battery support portion, a cell supported by the battery support portion, and a battery terminal electrically connected with the cell, the battery housing providing a battery port including a housing support portion engageable with the battery support portion to support the battery pack on the housing; and an operational circuit supported by the housing, the circuit including a circuit terminal supported by the battery port and electrically connectable with the battery terminal to electrically connect the battery pack to the circuit, the operational circuit being electrically connectable between the illuminating portion and the battery pack and a second power source such that power is suppliable to the illuminating portion, the circuit being electrically connected to the first lighting element and to the second lighting element and being operable to supply power from the battery pack to the first lighting element and to supply power from the second power source to the second lighting element, the circuit including a battery charging circuit portion electrically connectable between the battery pack and the second power source such that power is suppliable from the second power source to the battery pack to charge the battery pack.

23. A light comprising:

a light housing;

a light source supported by the light housing;

a base operable to support the light housing such that the light housing is movable relative to the base between a closed position and an open position, the base including a recessed section that receives a portion of the light housing when the light housing is in the closed position, the base also operable to support a removable power tool battery pack, the battery pack being removable from the housing by hand without any disassembly;

a power cord coupled to the base and electrically connectable to an AC power source; and a circuit selectively electrically connecting the light source and the removable power tool battery pack, and the circuit selectively electrically connecting the light source and the AC power source such that power is selectively suppliable to the light source from the removable power tool battery pack and the AC power source, the circuit including a battery charging circuit portion selectively electrically connecting the removable power tool battery pack and the AC power source such that power is selectively suppliable from the AC power source to the removable power tool battery pack to charge the removable power tool battery pack.

24. The light of claim 23, wherein the removable power tool battery pack is a first removable power tool battery pack, and wherein the base is operable to further support a second removable power tool battery pack, the circuit selectively electrically connecting the light source to both the first and second removable power tool battery packs, power is selectively suppliable to the light source from both the first and second removable power tool battery packs and the AC power source, the battery charging circuit portion selectively electrically connecting the first and second removable power tool battery packs and the AC power source such that power is selectively suppliable from the AC power source to the first and second removable power tool battery packs to charge the first and second removable power tool battery packs.

25. The light of claim 23, wherein the light housing is rotatable relative to the base.

26. A light assembly comprising:

a light source;

a base operable to support the light source and operable to support a removable power tool battery pack external to the base, the light source being movable with respect to the base, the base including a recessed section that receives a portion of the light source when the light source is in a first position and does not receive a portion of the light source when the light source is in a second position; and a circuit selectively electrically connecting the light source and the removable power tool battery pack, and the circuit selectively electrically connecting the light source and a second power source such that power is selectively suppliable to the light source from the removable power tool battery pack and the second power source, the second power source being different than the removable power tool battery pack.

27. The light assembly of claim 26, wherein the circuit includes a battery charging circuit portion selectively electrically connecting the removable power tool battery pack and the second power source such that power is selectively suppliable from the second power source to the removable power tool battery pack to charge the removable power tool battery pack.

28. The light assembly of claim 26, and further comprising a power cord electrically connected to the circuit and operable to connect the circuit to the second power source.

29. The light assembly of claim 26, wherein the second power source is an AC power source.

30. A light comprising:

a light source;

a base operable to support the light source in one of a closed position and an open position and operable to support a removable power tool battery pack, the battery pack being removable from the base by hand without any disassembly;

a recessed section formed as part of the base and positioned to receive a portion of the light source when in the closed position to protect the light source, the recessed section of the base being operable to block light from the light source when the light source is in the closed position; and a circuit selectively electrically connecting the light source, a power source, and the removable power tool battery pack such that power is suppliable to the light source from each of the removable power tool battery pack and the power source, the circuit including a battery charging circuit portion selectively electrically connecting the removable power tool battery pack and the power source such that power is suppliable from the power source to the removable power tool battery pack to charge the removable power tool battery pack.

31. The light of claim 30, wherein the circuit selectively electrically connects the light source to the power source such that power is suppliable to the light source from the removable power tool battery pack and the power source.

32. The light of claim 30, and further comprising a power cord electrically connected to the circuit and operable to connect the circuit to the power source.

33. The light of claim 32, wherein the power source is an AC power source.

* * * * *

UNITED STATES PATENT AND TRADEMARK OFFICE

CERTIFICATE OF CORRECTION

PATENT NO. : 7,621,652 B2
APPLICATION NO. : 11/393258
DATED : November 24, 2009
INVENTOR(S) : Jonathan Zick It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 511 days.

Signed and Sealed this

Twenty-sixth Day of October, 2010

David J. Kappos

David J. Kappos
*Director of the United States Patent and Trademark Office*